US009732534B2

(12) United States Patent
Allen et al.

(10) Patent No.: US 9,732,534 B2
(45) **Date of Patent: *Aug. 15, 2017**

(54) FALL PROTECTION GUARDRAIL

(71) Applicants: Darrell Allen, Westlake Village, CA (US); Gary Hardy, Santa Barbara, CA (US)

(72) Inventors: Darrell Allen, Westlake Village, CA (US); Gary Hardy, Santa Barbara, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/185,934

(22) Filed: Jun. 17, 2016

(65) Prior Publication Data

US 2016/0298346 A1 Oct. 13, 2016

Related U.S. Application Data

(63) Continuation of application No. 14/668,817, filed on Mar. 25, 2015, now Pat. No. 9,371,666.
(Continued)

(51) Int. Cl.

| | |
|---|---|
| ***E04G 3/20*** | (2006.01) |
| ***E04G 21/32*** | (2006.01) |
| ***E04H 17/20*** | (2006.01) |
| ***E04G 5/06*** | (2006.01) |
| ***E04H 17/14*** | (2006.01) |

(52) U.S. Cl.

CPC ..... *E04G 21/3219* (2013.01); *E04G 5/062* (2013.01); *E04G 21/3242* (2013.01); *E04G 21/3247* (2013.01); *E04H 17/1421* (2013.01); *E04H 17/20* (2013.01); *Y10T 29/49826* (2015.01); *Y10T 29/49947* (2015.01)

(58) Field of Classification Search

CPC E04G 5/04; E04G 5/045; E04G 5/046; E04G 5/061; E04G 5/062; E04G 3/20

See application file for complete search history.

(56) References Cited

U.S. PATENT DOCUMENTS

| | | | |
|---|---|---|---|
| 3,425,509 | A | 2/1969 | Gilbert et al. |
| 3,669,480 | A | 6/1972 | Fugate |

(Continued)

FOREIGN PATENT DOCUMENTS

| | | |
|---|---|---|
| EP | 2447549 | 10/2010 |
| GB | 2127887 | 9/1982 |
| JP | 11140836 | 5/1999 |

*Primary Examiner* — Michael P Ferguson

(74) *Attorney, Agent, or Firm* — Cislo & Thomas, LLP

(57) ABSTRACT

A fall protection guardrail system and method used for construction of multi-story wood-framed buildings, which comprises a support bracket comprised of an attachment member and a pole support, and further comprises a pole with integrated rail supports. For a framed wall that is lying in a horizontal position, the support bracket is easily attached to a framing member of the framed wall, and the pole is inserted into the pole support. Then the framed wall is moved into the vertical position and secured to other framing. When the floor or roof is placed atop the framed wall, rails are inserted into the rail supports and secured. When the building is finished, the guardrail support system is easily removed, disassembled, and reusable. In some embodiments, a scaffolding frame may be attached to the support bracket, and the pole inserted into the scaffolding frame.

13 Claims, 9 Drawing Sheets

Related U.S. Application Data

(60) Provisional application No. 61/970,227, filed on Mar. 25, 2014.

(56) References Cited

U.S. PATENT DOCUMENTS

| | | | | |
|---|---|---|---|---|
| 3,863,899 | A | 2/1975 | Werner | |
| 3,995,833 | A | 12/1976 | McLaughlin et al. | |
| 4,998,484 | A | 3/1991 | Groetzinger | |
| D484,617 | S | 12/2003 | Micheals | |
| 6,840,015 | B1 | 1/2005 | Ashley | |
| 6,908,075 | B1 | 6/2005 | Nichols | |
| 7,360,627 | B2 | 4/2008 | Scott | |
| 7,377,491 | B2 | 5/2008 | Fuoco | |
| D598,734 | S | 8/2009 | Miranda et al. | |
| 8,132,792 | B2 | 3/2012 | Perris | |
| 8,448,923 | B1 | 5/2013 | Schad et al. | |
| 8,517,144 | B2 | 8/2013 | Cuccurullo et al. | |
| 9,371,666 | B2 * | 6/2016 | Allen | E04H 17/20 |
| 2003/0015696 | A1 | 1/2003 | Watson | |
| 2004/0020713 | A1 * | 2/2004 | Fregosi | E04G 5/06 182/82 |
| 2004/0041141 | A1 | 3/2004 | Cannon | |
| 2010/0326769 | A1 * | 12/2010 | Cuccurullo | E04D 13/0335 182/97 |

* cited by examiner

FALL PROTECTION GUARDRAIL

CROSS-REFERENCE TO RELATED APPLICATION

This application is a continuation of U.S. patent application Ser. No. 14/668,817, entitled "Fall Protection Guardrail," filed on Mar. 25, 2015, which claims the benefit of U.S. Provisional Patent Application Ser. No. 61/970,227, entitled "Fall Protection Guardrail," filed Mar. 25, 2014, which applications are incorporated in their entirety here by this reference.

TECHNICAL FIELD

The present invention relates to a guardrail support used during construction and, more particularly, to a novel guardrail support for use in the erection of a fall protection barrier at multi-story construction sites using wood framing.

BACKGROUND

Modern construction techniques applicable to multi-story apartment and commercial building construction require that safety barriers or guardrails be erected around the perimeter of all uncompleted floors to protect workers against accidental falls. In the United States, safety regulations require construction worker fall protection for any walking or working surface that is six feet (1.8 meters) or more above a lower level. Guardrail systems are a common means of fall protection. Safety regulations often require that guardrail systems have at least two rails, a top rail with a top edge that is typically 39-45 inches (1.0-1.2 meters) above the walking/working level, and a midrail that is midway between the walking/working level and the top rail.

The general practice to erect such fall protection safety barriers, particularly in wood-framed buildings, is to use long "2×4" boards (commonly referred to as "two-by-fours"). Such boards are nailed together in varying patterns in order to provide the desired guard railings. After such railings have served their purpose, they are knocked down, the longer boards typically reserved for future guard railings. The shorter boards are not always reusable. Furthermore, the longer lengths of lumber frequently become damaged due to the application thereto of repeated impact blows, different nail placements, and when tearing out nails upon disassembly. Although such makeshift guard railings may meet safety requirements, they require more than one person and a fair amount of time to construct and often result in the destruction of the materials used when they are disassembled after completion of work at a construction site. Obviously, the additional labor and cost of materials used will add to the expense of the job. Many such railings also fail to pass the rigidity requirements of safety inspectors.

As a result, various designs have been proposed to aid in erecting temporary fall protection barriers that meet strict safety guidelines. To a large extent, however, most of the proposed designs are impractical, expensive, and too complicated. Guardrail systems that are too complicated will not be used efficiently and/or properly by workmen at a construction site, thereby posing a safety risk.

Therefore, a need exists for a simple and reusable guardrail system that is effective in preventing accidental falls, meets safety guidelines, and can be assembled and disassembled efficiently.

SUMMARY

A fall protection guardrail support and assembly for erecting a fall protection barrier for workmen at construction sites, particularly in wood-framed buildings, is disclosed herein. Some of the advantages of the guardrail support disclosed herein are that it is quick and easy to install and assemble and disassemble. The components are reusable, and the lumber used for the rails suffers less damage on disassembly than in most current systems, thus allowing its reuse in most situations.

In accordance with a first aspect of the present invention, a guardrail support for a temporary safety barrier is provided wherein the guardrail support comprises a support bracket adapted with a positioning stop to position a support bracket against a vertical wall framing member and further adapted to attach to the vertical framing member, wherein the support bracket also extends laterally from the wall framing member to an integral pole support that is vertically oriented, and a pole that is adapted to fit into the pole support, the pole having an upper rail support adapted to hold a plurality of rails at a height required for a top rail, and a lower rail support adapted to hold a plurality of rails at a height required for a midrail. The rails are preferably comprised of 2×4 lumber, as it is inexpensive and readily available. The pole support and pole may have holes that match up when the latter is inserted into the former, such holes adapted to accommodate a safety pin or a screw, bolt, or other suitable device to prevent the pole from being accidentally removed from the pole support. The upper and lower rail supports of the pole may be equipped with a rail retention device, to prevent the rails from being accidentally removed from the rail supports, which may comprise a safety pin through a set of holes in the rail support and pole wherein the safety pin is located atop the rails or through a hole in the rails, a hinged top cover for the bracket that closes the bracket opening, or a screw through a support bracket into both rails, as shown in FIGS. 9 and 11, or any other suitable retention device to prevent accidental removal of the rails.

In accordance with another aspect of the invention, additional brackets may be attached to the support pole, adapted and positioned so that they can support a scaffolding, which may have fall protection afforded by the above-described rails. In such an embodiment, the support bracket and pole would have to be adapted to handle the additional weight from scaffolding. In an alternate embodiment, two or more support brackets could be used with a single support pole that has a longer insertion member. The framing member to which the support bracket(s) is attached should be capable of handling the scaffolding load, both vertically and in other load directions. Additional attachment points could be adapted for other uses.

DETAILED DESCRIPTION OF THE INVENTION

Figure 1:
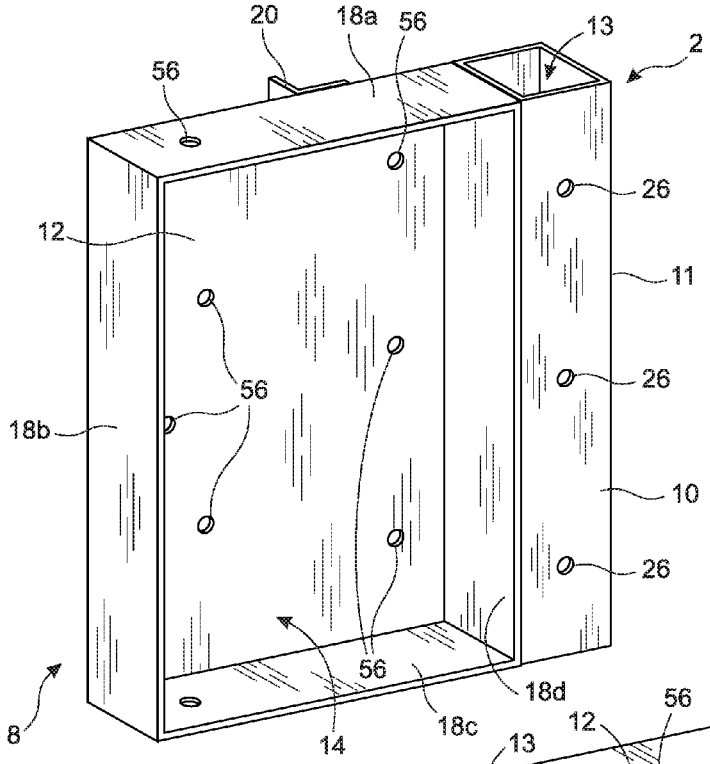
FIG. 1 depicts a perspective view of a support bracket of the present invention.

The detailed description set forth below in connection with the appended drawings is intended as a description of presently-preferred embodiments of the invention and is not intended to represent the only forms in which the present invention may be constructed or utilized. The description sets forth the functions and the sequence of steps for constructing and operating the invention in connection with the illustrated embodiments. It is to be understood, however, that the same or equivalent functions and sequences may be accomplished by different embodiments that are also intended to be encompassed within the spirit and scope of the invention.

The fall protection guardrail described herein includes a novel support bracket 2 that attaches to framing 4 and holds a pole 6 that has a top end 5 and a bottom end 7. As shown in a preferred embodiment depicted in FIGS. 1 and 2, the support bracket 2 may comprise two components, an attachment member 8 and a pole support 10.

The attachment member 8 may be constructed of an attachment face 12, with a first surface 14 and a second surface 16, and four sides. The attachment face 12 may be rectangular and substantially planar, and its surface may define at least one attachment hole 56. On one or more sides of the attachment face 12, reinforcing members 18*a-d* are coupled with the attachment face 12. The reinforcing members 18*a-d* may be planar rectangles such as flat bar stock, typically arranged perpendicular to the attachment face 12. The reinforcing members 18 may also be other shapes (not shown) such as an L-shape (angle iron), square or rectangular tubing, channel bar, I-beam, T-bar, or any other suitable shape, and may be arranged in any suitable configuration on the attachment face 12. In a preferred embodiment the attachment face 12 is approximately 10 inches (25.4 cm)×6 inches (15.24 cm), although other dimensions may be used.

In a preferred embodiment, the attachment member 8 may be comprised of a single sheet of steel, with cut out corners, wherein the sides are folded up on the first side of the attachment face 12 to form the reinforcing members 18*a-d*, and their corners are fastened together, typically by welding, but any suitable attachment method may be used. The resulting open "box" may have three sides 18*a-c* or four sides 18*a-d*. Alternatively, the reinforcing members 18*a-d* can comprise separate bar stock or other shapes described above, welded or otherwise coupled with the attachment face 12, again with three or four sides. In either case, the attachment member may comprise a top reinforcing member 18*a*, a bottom reinforcing member 18*c* opposite and parallel to the top reinforcing member 18*a*, and a side reinforcing member adjacent 18*b*, perpendicular, and attached to the top and bottom reinforcing members 18*a*, 18*c* to form the open box configuration, wherein the side reinforcing member 18*b* is opposite the pole support 10. In some embodiments, the pole support 10 may make up the fourth reinforcing member to complete the open box configuration. In other embodiments, a second side reinforcing member 18*d* may be attached to the attachment member 8 opposite the first side reinforcing member 18*b* and adjacent and perpendicular to the top and bottom reinforcing members 18*a*, 18*c*. The pole support 10 may be attached to the second side reinforcing member 18*d*.

In a preferred embodiment, the pole support 10 may be constructed of square tubing, although other shapes of tubing may be used so long as the tubing comprises at least one wall 11 defining a first cavity 13. As used herein, the term "square tubing" shall include any rectangular tubing with equal or unequal side dimensions. Square tubing may be advantageous to keep the pole 6 in a certain orientation without use of a pin, and also has greater bending strength than round tubing for a given thickness when the moment is in line with the sides of the tubing. Square tubing may also be easier to attach to the square sides of the attachment member 8 "box." Square tubing also has an advantage if a safety pin is used, described below. Nevertheless, other shapes of tubing may be used for the pole support 10. However, non-cylindrical shaped tubing is preferred to prevent unwanted rotation of the pole 6 within the pole support 10. In a preferred embodiment, the pole support 10 is comprised of square tubing defining a first cavity 13 having a first cavity dimension of approximately 1.25 inches (3.175 cm) by 1.25 inches and an outer pole support dimension of approximately 1.5 inches (3.81 cm) by 1.5 inches, although other dimensioned tubing may be used.

The attachment member 8 may then be coupled with the pole support 10. The pole support 10 may be coupled with the attachment member 8 by welding or other suitable methods. In a preferred embodiment, the attachment member 8 is a three-sided "box," and the pole support 10 is a piece of square tubing with a side dimension that is the same width as the reinforcing members 18*a-c*, wherein the square tubing may be welded or otherwise coupled with the attachment member 8 so that the square tubing becomes the fourth side of the "box" and acts as a reinforcing member 18*d*.

Figure 2:
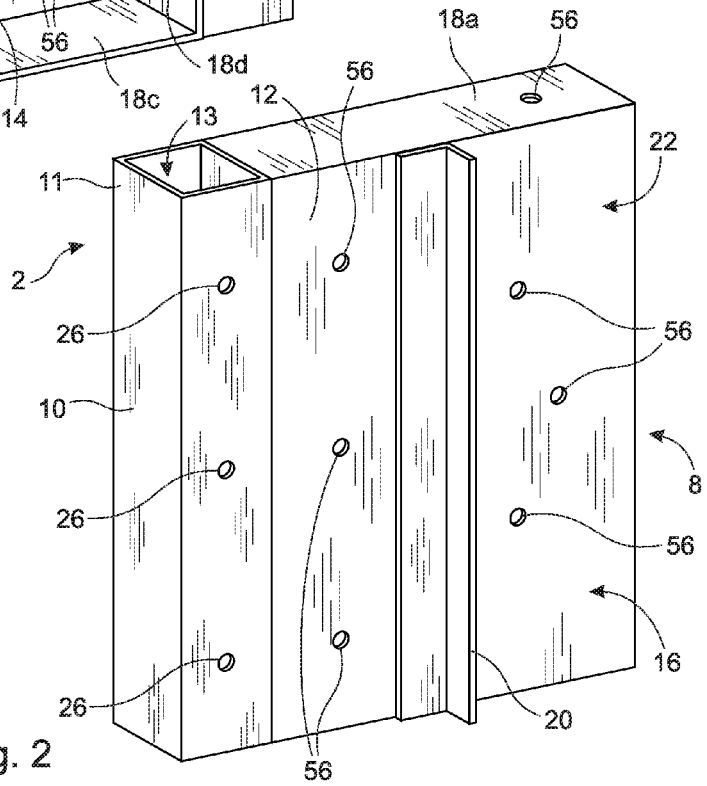
FIG. 2 depicts a perspective view of a support bracket of the present invention.

As shown in FIGS. 1 and 2, in a preferred embodiment the attachment member 8 is a rectangle with unequal sides, where one of the long sides is coupled with the pole support 10. Although the pole support 10 is shown as being the same length as the long side of the attachment member 8, the pole support 10 could be longer or shorter.

Figure 3:
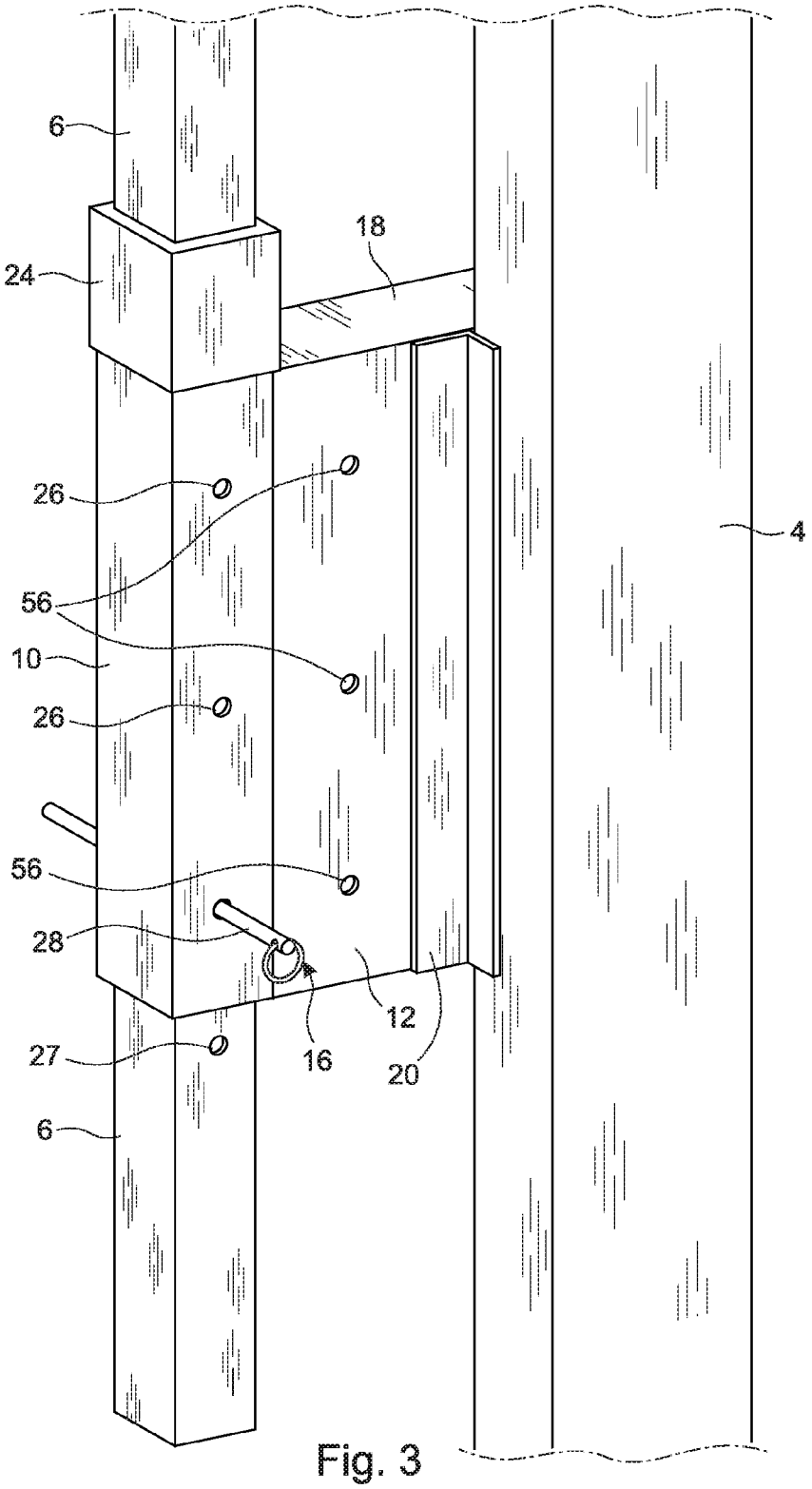
FIG. 3 depicts a perspective view of the present invention in use on a framing member.

As shown in FIGS. 1 and 2, in a preferred embodiment a positioning member 20 is attached to the second surface 16 of the attachment face 12. The purpose of the positioning member 20 is to act as a stop to accurately position a first portion of the second surface 16 of the attachment face 12 of the attachment member 8 that is distal to the pole support 10 against a building framing member 4, as shown in FIG. 3. Preferably, the first portion of the second surface 16 of the attachment face 12 touching the framing member 4 (referred to as the "attachment surface" 22) is approximately equal to the width of the framing member 4, although it may be wider or narrower. For example, for a building made with 2×4 framing members 4 (which are nominally 1.5 inches×3.5 inches (3.81 cm×8.89 cm)), the attachment surface 22 would be 3.5 inches wide. For a building with framing members 4 that are larger, the attachment surface 22 could be sized to match, or be kept at the same 3.5 inch size, or made larger or smaller. Although the positioning member 20 is shown as a piece of angle iron in FIGS. 1-3, it may be any suitable structure that makes the attachment surface 22 the appropriate dimension, whether it be one or more "ears" cut into the attachment face 12 and bent up to act as a stop, or some other type of bar stock, round stock, or any suitable shaped protrusion. The attachment surface 22 may be equipped with attachment holes 56 to accommodate fasteners 42, described below.

In some embodiments, the attachment face 12 may have attachment holes 56 on both sides of the positioning member 20. This allows the attachment member 8 to be attached to a framing member with the first surface 14 facing the framing members 4. This may be suitable when framing members 4 are made with large 2×6 or 2×8 beams, and the like. Stronger screws or fastening devices may be used to secure the attachment member 8 in this manner.

As shown in FIG. 3, a pole 6 may be adapted to fit into the pole support 10 and equipped with a pole stop 24 in between the top end 5 and the bottom end 7, but preferably near its bottom end 7. Thus, the bottom end 7 defines a pole support insert 9. The pole stop 24 insures that the pole support insert 9 is suitably inserted into the pole support 10, but insures the pole 6 cannot slip further into the pole support 10 than necessary. The pole stop 24 may be constructed of bar stock or square tubing that is the same dimension as the pole support 10, and welded or suitably fastened to the pole 6 at the desired location. In a preferred embodiment, the pole 6 is comprised of square tubing that has an inner dimension of approximately 1.0 inches (2.54 cm) by 1 inch, and an outer dimension of approximately 1.25 inches (3.175 cm) by 1.25 inch.

As shown in FIG. 3, both the pole support 10 and the pole 6 may be equipped with corresponding pole locking pin holes 26, 27, through which a pole locking pin 28 may be inserted to prevent the pole 6 from accidentally falling or lifting out of the pole support 10. The pin holes 26, 27 may be spaced apart in regular increments, such as two inch increments so that the proper height of the pole 6 can be selected, for example to accommodate 10-inch, 12-inch, 14-inch floor joists, and the like. The pole locking pin 28 may be a standard spring and ball detent pin, such as those sold under the Kwik-Lok® brand, with or without a release button, or any other suitable locking pin, including but not limited to heavy duty cotter pins, pintle pins, industrial safety and snap pins, or other suitable retaining pins. The pole locking pin 28 may be attached to either the pole 6, the support bracket 2 or the pole support 10 by a wire cable or other suitable retaining device, so that that a pole locking pin 28 is always within reach.

Figure 4:
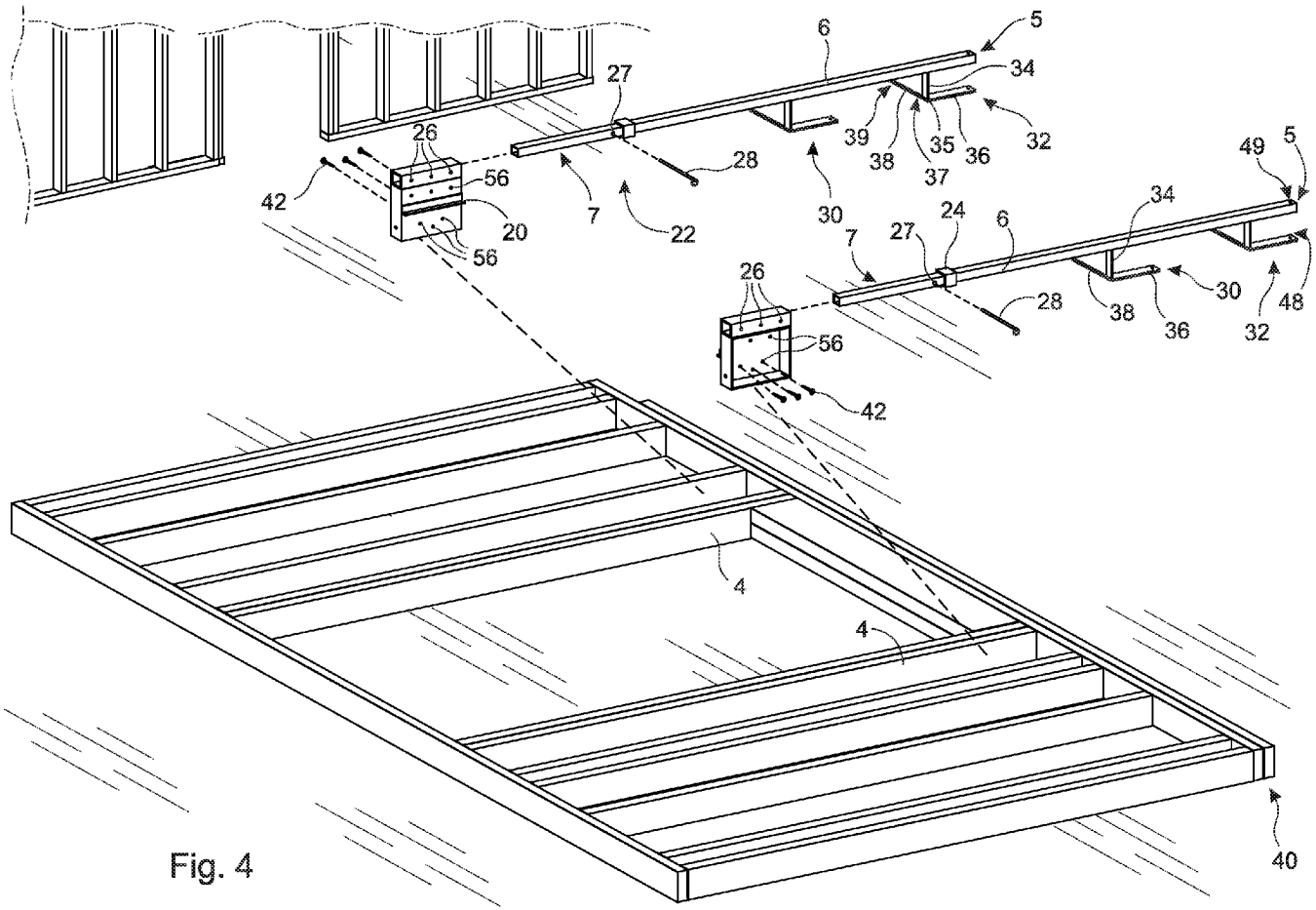
FIG. 4 depicts an exploded view of the present invention and a framed wall in a horizontal position.

As shown in FIG. 4, in a preferred embodiment the upper portion of the pole 6 is comprised of a lower rail support 30 and an upper rail support 32. The rail supports 30, 32 may be constructed of bar stock welded into the desired configuration. In a preferred embodiment, the rail support is comprised of an L-shaped piece of bar stock that is coupled with the pole 6 near the top end and a diagonal element 38 coupled with the L-shaped piece of bar stock. The L-shaped piece of bar stock comprises a horizontal element 34 and vertical element 36 connected at a corner 35. The diagonal element 38 is coupled to the corner 35 of the "L" and also coupled with the pole 6 at a position distal to the pole's 6 top end to act as a support for the "L." In particular, the diagonal element 38 has a first end 37 and a second end 39 opposite the first end 37, the first end 37 of the diagonal element 38 coupled to the corner 35 of the L-shaped piece of bar stock and the second end 39 of the diagonal element 38 attached to the pole 6 at a position below the horizontal element 34 to act as a support for the L-shaped piece of bar stock.

The rail supports 30, 32 may be constructed in any configuration or manner to provide sufficient support for the rails 44. The rails 44 are elongated structures, each rail having a length L, a width W, and a thickness T, wherein the length L is greater than the width W, and the width W is greater than or equal to the thickness T.

In a preferred embodiment, the vertical element 36 of the "L" of the rail support is at least as tall as the width W of the rail 44. The vertical element 36 of the "L" of the upper rail support 32 would typically terminate at or near the same height as the pole 6. For example, when using 2×4 lumber as rails 44, the vertical element 36 of the "L" of the rail support would be at least 3.5" tall. In a preferred embodiment, the horizontal element 34 of the "L" of the rail support may have a length that is approximately twice the thickness T of the rail 44 to accommodate two rails 44, as shown in FIGS. 6-9. For example, when using 2×4 lumber as rails 44, the horizontal element 34 of the "L" of the rail support would be at least 3.0 inches (7.62 cm) wide on the interior, to accommodate two rails 44, each having a thickness T of 1.5 inches with a bit of excess space to allow some play.

As shown in FIG. 4, a framed wall 40 is typically constructed on the ground or other horizontal surface. When the wall framing is complete but still lying horizontally, the attachment surface 22 of the support bracket 2 may be placed against a framing member 4, and attached to the framing member 4 by screws, nails, or other fasteners 42 driven through the attachment holes 56 into the framing member 4. As shown in FIGS. 1 and 2, the topmost reinforcing member may also have one or more attachment holes 56, and a fastener 42 may be driven through the hole(s) and into the top plate 42 of the wall framing 40. The fasteners 42 should be of sufficient strength to hold the support bracket 2 to the framing member 4 when the guardrail system is assembled and under the specified minimum load. In a typical configuration, the support bracket 2 is fastened to the framed wall 40 such that the pole support 10 is located on the outside of the wall.

Figure 5:
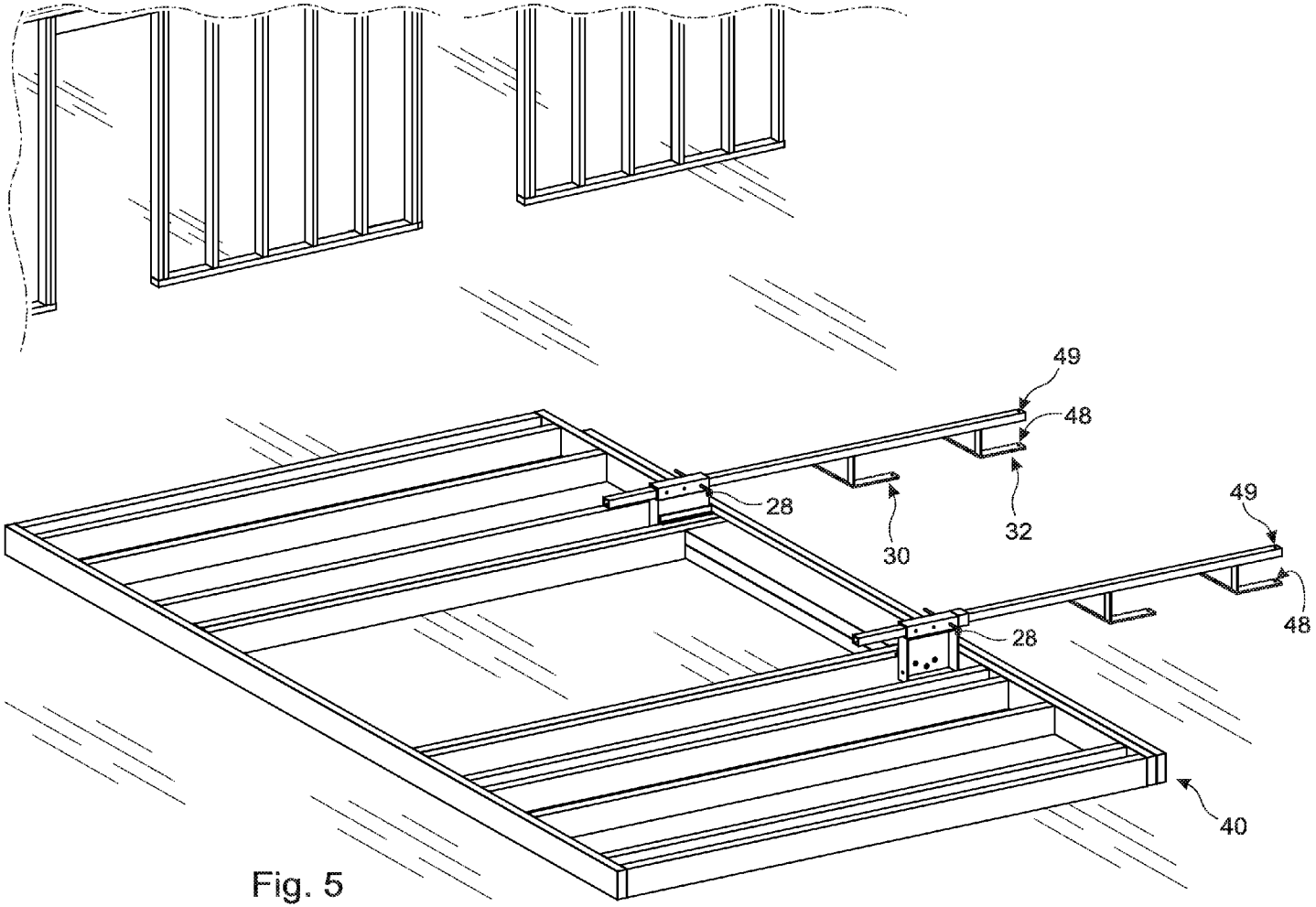
FIG. 5 depicts a perspective view of the present invention installed on a framed wall in a horizontal position.

At some point, preferably before the framed wall 40 is raised to the vertical position, the pole 6 is placed into the pole support 10. A pole locking pin 28 may be inserted into the pole locking pin holes 26, 27 as shown in FIG. 5. Then the wall is raised to the vertical position and secured to other framing, and the guardrail supports are already in position. Once the floor (not shown) is attached to the top of the framed wall 40, the rails 44 can be placed into the rail supports 30, 32.

Figure 6:
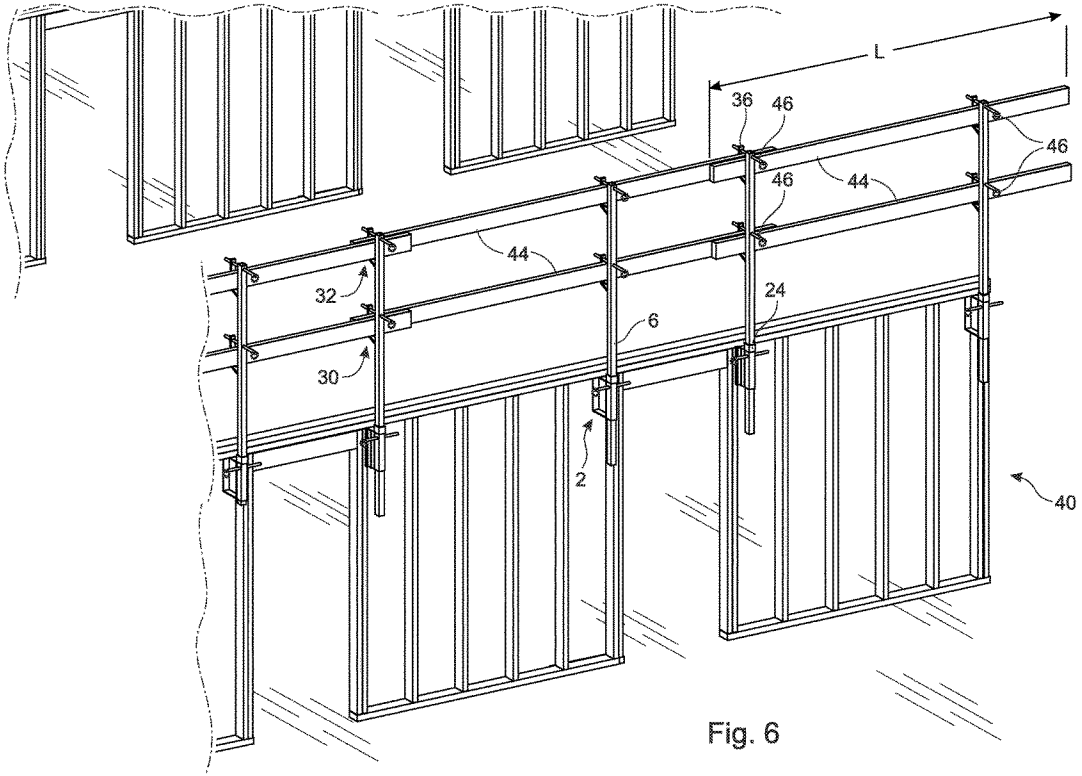
FIG. 6 depicts a perspective view of the present invention installed on a framed wall in a vertical position.

In a preferred embodiment, the vertical element 36 of the "L" of each rail support would be taller than the width W of the rail 44 to accommodate a rail locking pin 46 to function as the retention device. As shown in FIG. 6, in such a configuration, the pole 6 and the vertical element 36 of the "L" of the rail support would define corresponding rail locking pin holes 48, which are typically located slightly higher than the largest dimension of the rail. After the rails 44 are placed into the rail supports 30, 32, the rail locking pins 46 are inserted into the rail locking pin holes 48, 49 to retain the rails 44 in the rail supports 30, 32, as shown in FIG. 6.

Figure 7:
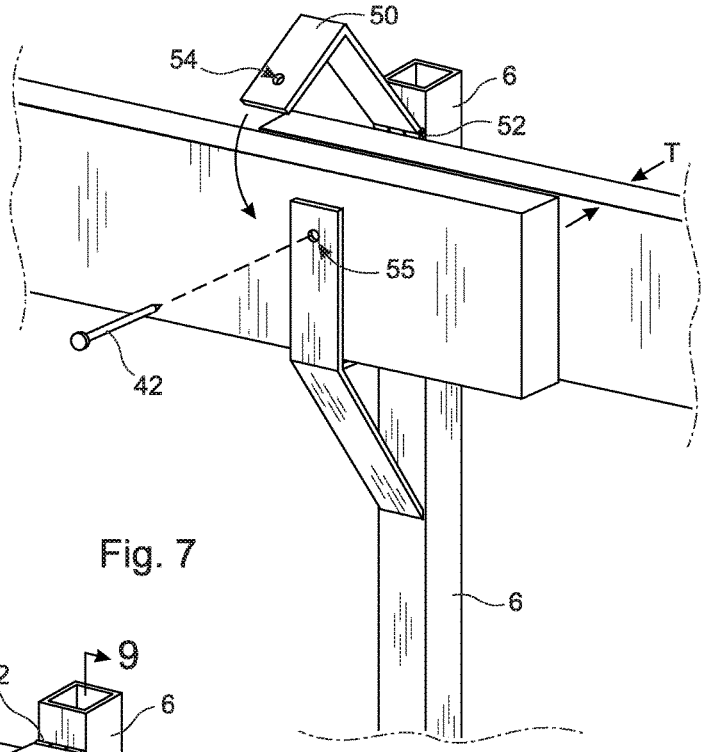
FIG. 7 depicts a close-up perspective view of an embodiment of the rail support of the present invention.
Figure 8:
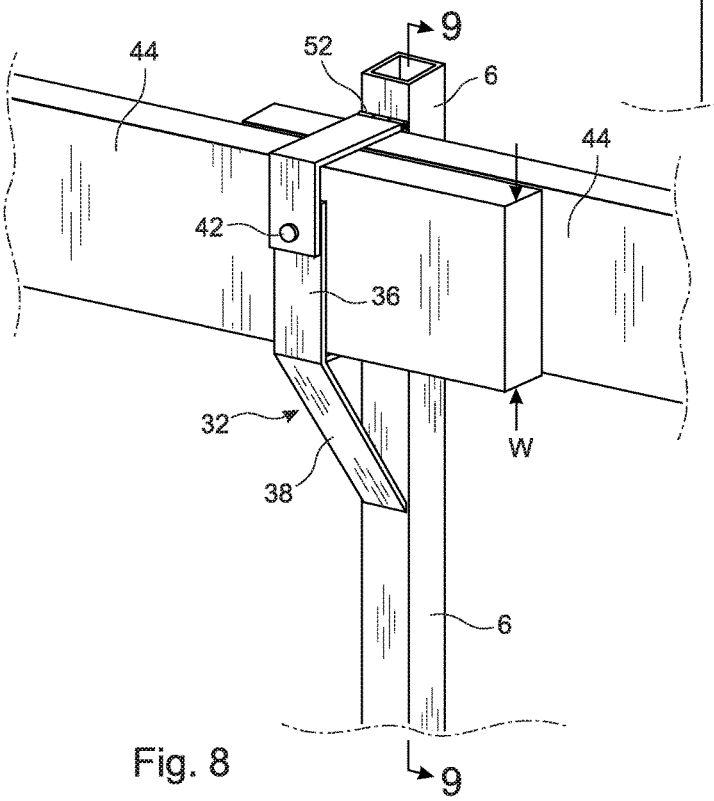
FIG. 8 depicts a close-up perspective view of an embodiment of the rail support of the present invention.
Figure 9:
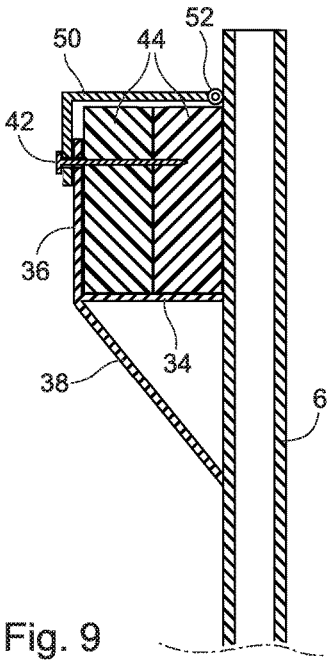
FIG. 9 depicts a cross section view taken through line 9-9 of the embodiment of the present invention shown in FIG. 8.

In alternative embodiments, the rails 44 may be retained in the rail supports 30, 32 by other structures that serve as the retention device. In FIGS. 7-9, one such alternative embodiment is shown, which comprises a vertical element 36 of the "L" of the rail support that is the same height or slightly shorter than the larger dimension of the rail, and a retention clamp 50 as the retention device, which may be an "L" shaped element coupled with the pole 6 by a hinge 52 or other suitable attachment method or apparatus. The vertical element 36 of the "L" of the rail support and the retention clamp 50 may have corresponding retention holes 54, 55 and a nail, screw, or other fastener 42 may be driven through the retention holes 54, 55 and into one or both rails 44 to secure the rails 44 in the rail support, as shown in FIGS. 7-9. Alternatively, the retention clamp 50 may be omitted and a fastener 42 may be driven through a retention hole in the vertical element 36 of the "L" of the rail support, or through a retention hole in the pole 6, or both, into one or both of the rails 44.

Figure 11:
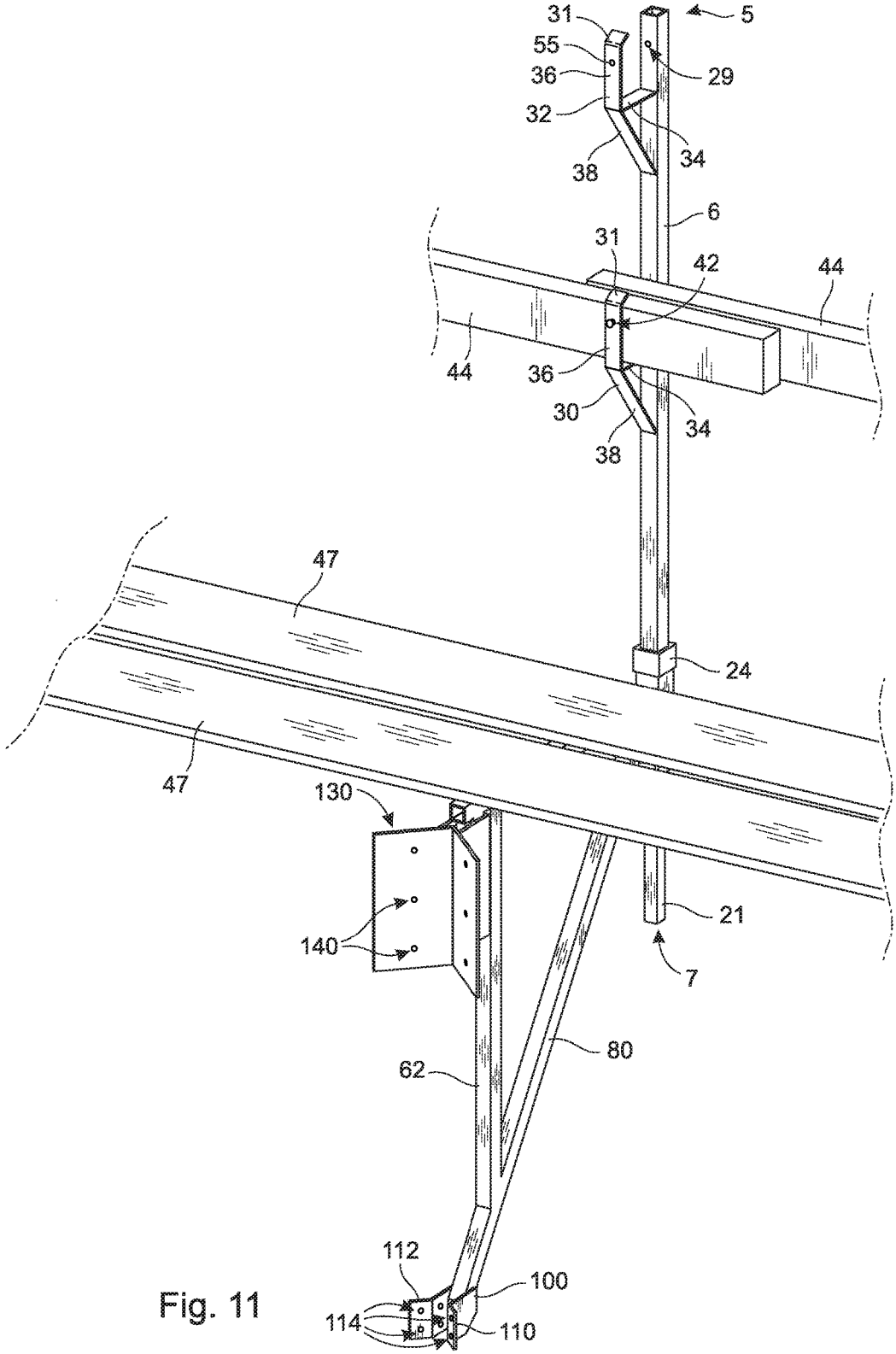
FIG. 11 depicts the embodiment shown in FIG. 10 in use.

In yet another embodiment, the retention device may be a retention lip 31 that is at the top of the vertical element 36 and extends towards the pole 6. The retention lip 31 could be any structure that extends towards pole 6, such as a bent portion of the vertical element 36, a separate welded element, or any suitable structure. As shown in FIG. 11, to secure a pair of rails in this embodiment, a first rail 44 is placed against the vertical element 36, beneath the retention lip 31, and a second rail 44 is placed between the first rail 44 and the pole 6, and at least one fastener 42 is driven through both the first and second rails 44, which lock them together. Then the retention lip 31, which is of sufficient length to engage the top of the first rail 44, prevents these locked-together rails 44 from lifting out of the rail support 30, 32. To prevent the rails 44 from moving laterally within the rail support 30, 32, one or more fasteners 42 with a protruding head could be driven through the rails 44 on one side or both sides of the vertical element 36 or the pole 6, wherein the protruding head would engage the vertical element 36 or the pole 6 to prevent significant lateral movement of the rails 44. Alternatively, the pole 6 and/or the vertical element 36 could have one or more holes 55 through which a single fastener 42 could be driven into the rails 44 to prevent both lateral and vertical movement of the rails. This latter embodiment could be used with or without the retention lip 31.

In some embodiments, the support bracket 2 could be used to support a pole 6 that holds scaffolding 47. The support bracket 2 and pole 6 would have to be sized to accommodate the additional load of the scaffolding 47 and the worker(s) using the scaffolding 47, as well as the live loads from those worker(s). A longer support bracket 2 may be used to spread the load over a greater length of the framing member 4. Alternatively, several smaller support brackets 2 may be used to support a single pole 6. In some embodiments, the pole support 10 may be positioned farther away from the building than the guardrail supports described above, to accommodate the width of the scaffolding walking surface. The pole 6 may be long enough to insert into the entire length of such extended support bracket(s) 2, although a shorter or longer length could be used. In a preferred embodiment, the scaffolding may be supported by scaffolding supports, a similar structure as the rail supports 30, 32 attached to the pole 6, but wider and shallower to accommodate the scaffolding walking surface, which may typically be 12 to 18 inches (30.5 to 45.74 cm) wide. The scaffolding surface may be secured in a similar manner as the rails 44 of the above described guardrail system, with locking pins. Alternatively, the scaffolding walking surfaces could be mounted on the scaffolding supports in a similar manner as existing scaffolding systems, with the scaffolding supports adapted to such mounting. The end of a scaffolding walking surface may be supported by a scaffolding end support, which can be on two separate poles 6 close together, each with an end support, or a single pole 6 with two end supports. The scaffolding support may be further adapted to attach to the building. A guardrail system as described above could be integrated into the pole 6, with the pole 6 having rail supports 30, 32 extending above the scaffolding walking surface. Such guardrail system would typically be used to prevent falls from the scaffolding, and thus would be positioned on the outside of the scaffolding.

Alternatively, the scaffolding support pole could be a separate structure from the rail support pole. A scaffolding support pole could be placed into a support bracket, which bracket may have additional structure to attach to horizontal framing members to provide additional support. The scaffolding support pole may be substantially vertical and relatively close to the building, then have a cantilevered scaffolding support bracket incorporated into it that extends away from the building to hold the scaffolding walking surface. At the outer edge of the cantilevered scaffolding support bracket, another support bracket could be incorporated to hold a pole to support a guardrail system as described above.

In the preferred embodiment, a support bracket 2 and pole 6 may be used with our without a scaffolding frame 60. Without the scaffolding frame 60, the guardrail system works as described above. With the scaffolding frame 60, the scaffolding frame 60 would be attached to the support bracket 2 and the pole 6 would be attached to the scaffolding frame 60 so that the support bracket 2 supports the pole 6 via the scaffolding frame 60.

Figure 10:
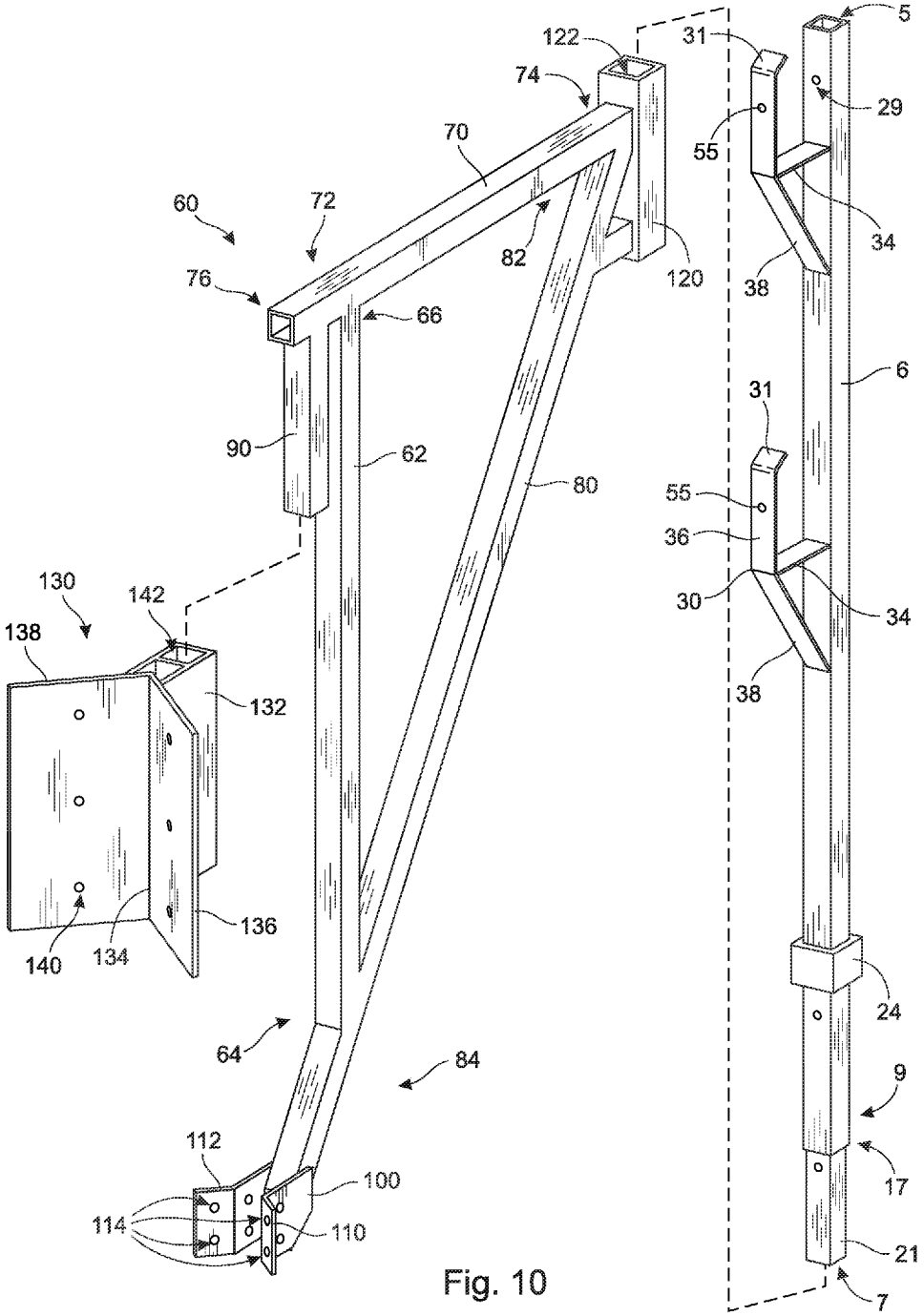
FIG. 10 depicts an exploded view of another embodiment of the present invention.

As shown in FIG. 10, in the preferred embodiment, the scaffolding frame 60 comprises a vertical support bar 62 having a lower end 64 and an upper end 66 opposite the lower end 64, a horizontal support 70 bar having a proximal end 72 and a distal end 74 opposite the proximal end 72, and a diagonal support bar 80 having a first end 82 and a second end 84 opposite the first end 82. The proximal end 72 of the horizontal support bar 70 is attached to the upper end 66 of the vertical support bar 62. The first end 82 of the diagonal support bar 80 is attached to the distal end 74 of the horizontal support bar 70, and the lower end 64 of the vertical support bar 62 is attached to the diagonal support bar 80 near the second end 84. Therefore, the vertical support bar 62, the horizontal support bar 70, and the diagonal support bar 80 generally define a triangular configuration.

In the preferred embodiment, the proximal end 72 of the horizontal support bar 70 extends past the vertical support bar 62, thereby terminating at a free terminal end 76. Attached to the horizontal support bar 70 in between the vertical support bar 62 and the free terminal end 76 of the horizontal support bar 70 may be another pole support insert 90. The pole support insert 90 extends downwardly and perpendicularly from the horizontal support bar 70 and parallel to the vertical support bar 62. The pole support insert 90 of the scaffolding frame 60 is substantially similar to the pole support insert 9 of the pole 6 so that either of the two can be inserted into the pole support 10 of the support bracket 2.

In the preferred embodiment, the second end 84 of the diagonal support bar 80 extends past the lower end 64 of the vertical support bar 62. The second end 84 of the diagonal support bar 80 may comprise a bottom bracket 100. In the preferred embodiment, the bottom bracket 100 comprises a first arm 102 and a second arm 104 opposite and parallel to the first arm 102, the first and second arms 102, 104 attached to the second end 84 of the diagonal support bar 80 with the first and second arms 102, 104 defining a gap therebetween. The distance between the first and second arms 102, 104 is sufficiently wide to receive the stud of the framing. Each of the first and second arms 102, 104 may define attachment holes 106 permitting the first and second arms 102, 104 to be fastened to a stud inserted therebetween.

Figure 12A:
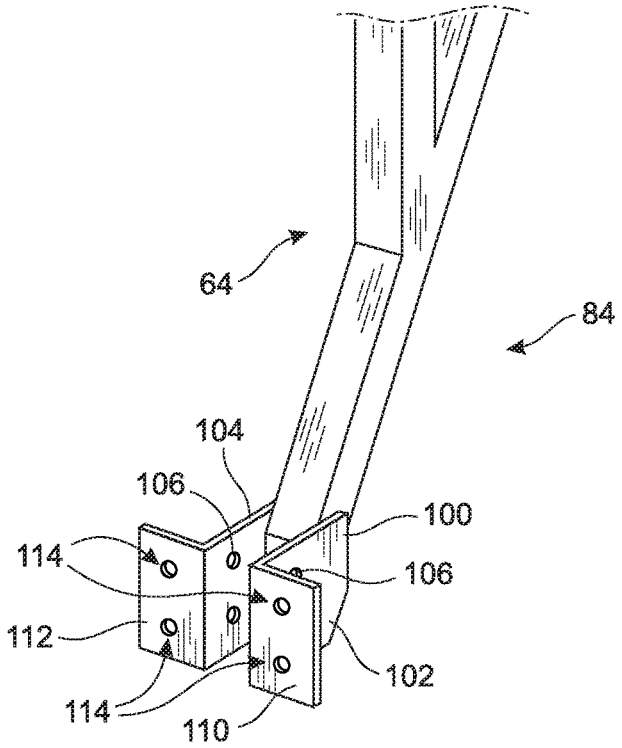
FIGS. 12A and 12B show variations of the bottom bracket.
Figure 12B:
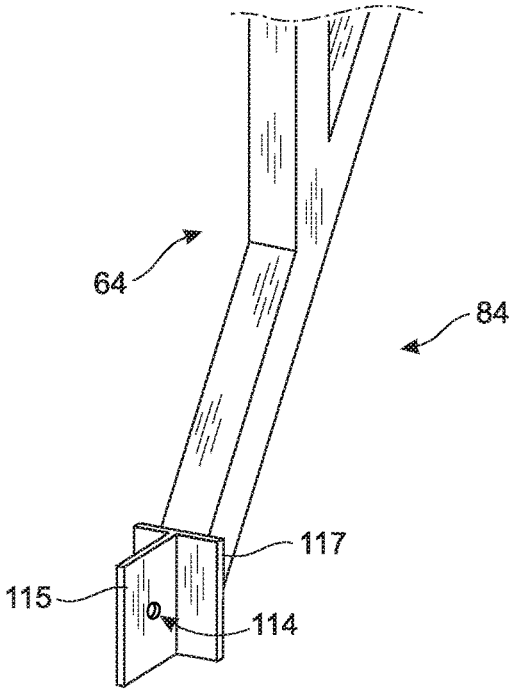

In some embodiments, the first arm 102 and the second arm 104 each may comprise flanged endings 110, 112 as shown in FIG. 12A. The flanged endings 110, 112 may be substantially perpendicular to their respective first and second arms 102, 104 and extend in opposite directions relative to each other. The flanged ends 110, 112 may be sufficiently parallel to each other so as to be able to rest flush against a flat surface. The flanged ends 110, 112 may also define attachment holes 114. This configuration allows the second end 84 of the diagonal support bar 80 to attach to an appropriately sized stud if the stud fits in between the first and second arms 102, 104, or to attach to a particularly wide frame portion by fastening the flanged ends 110, 112 flush against the frame. In an alternative embodiment, the bottom bracket 100 may have angled flanges 110, 112 as shown in FIGS. 10-11, adapted to fit corner framing members. In addition, as those in the art will appreciate, various pieces could be attached to the bottom bracket 100 shown in either FIG. 10 or FIG. 11, to accommodate a variety of angles and shapes to fasten to various framing members. In some embodiments, as shown in FIG. 12B, the bottom bracket 100 may be a T-bar having a flat base 117 and a perpendicular brace 115. The perpendicular brace 115 may have holes 114. The flat base 117 may be pressed flat against the front of the frame with the perpendicular brace 115 against the side of the frame. The perpendicular brace 115 can be fastened to the frame with a screw or some other fastener. In another embodiment, the perpendicular brace 115 can be located in another position along the face of the flat base 117 to be adapted to fit a particular side of a framing member. For example, the perpendicular brace 115 could located on the edge of the face of the flat base 117.

For corner scaffolding, the length of the horizontal support bar 70 may have to be longer to accommodate the scaffolding 47 because the scaffolding frame 60 for a corner is at a 45 degree angle to the scaffolding frames 60 that are mounted 90 degrees relative to the walls of the building.

A second pole support 120 may be attached to the distal end 74 of the horizontal support bar 70 and/or the first end 82 of the diagonal support bar 80, perpendicular to the horizontal support bar 70. The second pole support 120 defines a second cavity 122 having a second cavity dimension. Thus, with the scaffolding frame 60 installed on the first pole support 10 of the support bracket 2, the pole 6 can be installed on the second pole support 120 of the scaffolding frame 60.

As shown in FIG. 11, in the preferred embodiment, in which the pole 6 can be interchangeably inserted into the first pole support 10 (or corner bracket 130) or the second pole support 120, the pole support insert 9 of the pole 6 located below the pole stop 24 may comprise a stepped taper 17 to decrease an outer dimension of the pole support insert 9 in a stepwise manner moving towards the bottom end 7 of the pole 6, thereby defining a larger region 19 of the pole support insert 9 having a first dimension above the step 17 and a smaller region 21 of the pole support insert 9 having a second dimension below the step 17. The first dimension of the pole support insert 9 may be greater than the second dimension of the pole support insert 9 of the pole 6. The first cavity 13 dimension is substantially the same as the second dimension of the pole support insert 9, but smaller than the first dimension of the pole support insert 9 such that the larger region 19 of the pole support insert 9 cannot enter into the first cavity 13 of the first pole support 10 or the third cavity 142 of corner bracket 130.

The second cavity 122 dimension is substantially the same as the first dimension of the pole support insert 9, and larger than the second dimension of the pole support insert 9 such that the larger region 19 of the pole support insert 9 and the smaller region 21 of the pole support insert 9 can pass through the second cavity 122 until the second pole support 120 abuts against the pole stop 24.

The reason for the varying dimensions is to accommodate the required heights for rail heights. For example, fall protection guardrails typically have a top rail at 42 inches above the flooring and a mid-rail 21 inches above the flooring, whether that flooring is for a building or scaffolding. If a first pole support 10 (or corner bracket 130 discussed below) is mounted on a framing member below the floor joist or rim board, the pole 6 has to be long enough to accommodate that distance so that the rails 44 are at the required height above the floor. Thus, the smaller region 21 of the pole support insert 9 fits into the first cavity 13 of the first pole support 10 or the third cavity 142 of corner bracket 130 (discussed below), and stops when the larger region 19 of the pole support insert 9 abuts against the top of the first or third cavities 13, 142. In contrast, when the pole 6 is used for scaffolding, the horizontal support 70 defines the floor of the scaffolding 47, so there is no need to compensate for floor joist height. Thus the larger region 19 of the pole support insert 9 passes through the second cavity 122 until the top of the second pole support 120 abuts against the pole stop 24, which puts the rail supports 30, 32 at the proper heights for the scaffolding 47.

The guardrail system may further comprise a corner bracket 130 that can be substituted for the support bracket 2 when the guardrail is being installed at a corner of the framing 4. In the preferred embodiment, the corner bracket 130 may comprise a third pole support 132 and an angled attachment 134 member having a first plate 136 operatively connected to a second plate 138 at substantially a right angle. The third pole support 132 may be connected to the angled attachment member 134 where the first plate 136 meets the second plate 138. The first and second plates 136, 138 each comprise a plurality of attachment holes 140 to fasten the corner bracket 130 to a corner of the framing, wherein the third pole support 132 comprises a third cavity 142 having a third cavity dimension that is substantially equal to the first cavity dimension of the first pole support 10.

Therefore, in use, a support bracket 2 (or a corner bracket 130 if at a corner of the framing) may be fastened to a lower floor framing 4 lying horizontally on a ground, the lower floor framing 4 comprising a plurality of studs and a top plate. A pole support insert 9 or 90 may be inserted into the first pole support 10, wherein the pole support insert 9 or 90 is operatively connected to a pole 6 such that when the pole support insert 9 or 90 is inserted into the first pole support 10, a top end 5 of the pole 6 is at a desired height to create a guardrail that meets or exceeds government standards for temporary guardrail systems, wherein the pole 6 comprises at least one rail support 30, 32. The pole support insert 9 or 90 may be secured in the first pole support 10. The lower floor framing 9 can then be erected placing the rail support 30, 32 at the proper position. Rails 49 may be installed into the at least one rail support 30, 32, whereby the guardrail is properly positioned on an upper floor area to protect construction workers working on the upper floor from falling. In addition, a support bracket 2 or a corner bracket 130 could be installed at any point in the construction process, and guardrails and/or scaffolding placed as needed.

In some embodiments, in which a scaffolding is desired, the pole support insert 90 of a scaffolding frame 60 may be inserted into the first pole support 10, the scaffolding frame comprising a second pole support 120. The pole 6 is then inserted into the second pole support 120 to operatively connect to the pole support insert 90.

The foregoing description of the preferred embodiment of the invention has been presented for the purposes of illustration and description. It is not intended to be exhaustive or to limit the invention to the precise form disclosed. Many modifications and variations are possible in light of the above teaching. It is intended that the scope of the invention not be limited by this detailed description, but by the claims and the equivalents to the claims appended hereto.

What is claimed is:

1. A guardrail support system, comprising:

a. a support bracket that attaches to a substantially vertical stud of a building framing, the support bracket comprising an attachment member and a first pole support attached and adjacent to the attachment member, the first pole support comprising a cavity configured to receive a pole therein, wherein the attachment member comprises:

i. an attachment face having a first surface and a second surface, wherein the first and second surfaces are substantially planar and on opposite sides of the face, wherein at least a portion of the second surface is adapted to be positioned against the substantially vertical stud, wherein the attachment face defines at least one attachment hole to attach the support bracket to the substantially vertical stud, wherein the attachment hole is adapted to retain a fastener placed through the attachment hole into the substantially vertical stud, and ii. a plurality of sides extending along a periphery of the attachment face, wherein one or more of the plurality of sides comprises a reinforcing member arranged perpendicular to the attachment face and projecting from the first surface away from the vertical stud;

wherein the plurality of sides comprises a top reinforcing member, a bottom reinforcing member opposite and parallel to the top reinforcing member, and a side reinforcing member adjacent, perpendicular, and attached to the top and bottom reinforcing members to form an open box configuration, wherein the reinforcing members are projecting away from the vertical stud, and wherein the side reinforcing member is opposite the first pole support; and b. a pole configured to be inserted into the first pole support.

2. The guardrail support system of claim 1, wherein at least one of the plurality of sides comprising the reinforcing member arranged perpendicular to the attachment face are not in direct contact with the building framing.

3. The guardrail support system of claim 1, wherein the top reinforcing member comprises at least a second attachment hole adapted to retain a fastener placed through the attachment hole into an underside of a top plate of the building framing.

4. The guardrail support system of claim 1, wherein the attachment member further comprises a vertical positioning member attached to the second surface of the attachment face to function as a stop to accurately position an attachment surface of the attachment face of the attachment member against the substantially vertical stud, wherein the portion of the attachment surface to be positioned against the substantially vertical stud is distal to the first pole support.

5. The guardrail support system of claim 1, wherein the pole comprises:

a. a top end;

b. a bottom end opposite the top, the bottom end having a first pole support insert;

e. a pole stop in between the bottom end and the top end to insure that the pole is suitably inserted into the first pole support to a desired depth.

6. The guardrail support system of claim 5, wherein the pole further comprises rail supports for holding rails having a length, a width, and a thickness, wherein the length is greater than the width, and the width is greater than or equal to the thickness, wherein the rail supports comprise:

a. a lower rail support; and b. an upper rail support, each of the lower and upper rail supports comprising an L-shaped piece of bar stock, wherein the L-shaped piece of bar stock is formed by a horizontal element and a vertical element, the horizontal element and the vertical element defining a corner where the horizontal element and the vertical element intersect, wherein the horizontal element of the L-shaped piece of bar stock is attached to the pole and has a length that is at least twice the thickness of one rail to accommodate two rails.

7. The guardrail support system of claim 6, wherein at least one of the lower rail support or the upper rail support further comprises a diagonal element, the diagonal element having a first end and a second end opposite the first end, the first end of the diagonal element coupled to the corner of the L-shaped piece of bar stock and the second end of the diagonal element attached to the pole at a position below the horizontal element to act as a support for the L-shaped piece of bar stock.

8. The guardrail support system of claim 6, wherein at least one of the upper rail support or the lower rail support comprises a retention device to hold the rails in place.

9. The guardrail support system of claim 8, wherein the retention device is a retention lip bent towards the pole, and sized to accommodate the width of the rail.

10. The guardrail support system of claim 1, further comprising a corner bracket interchangeable with the support bracket, wherein the corner bracket comprises a second pole support and an angled attachment member having a first plate operatively connected to a second plate at substantially a right angle, said first and second plates each having inner and outer surfaces, wherein at least one of the inner surfaces of the first plate and second plate is adapted to contact at least one substantially vertical surface of the corner framing, the second pole support is connected to the angled attachment member approximately where the first plate meets the second plate such that when the corner bracket is attached to a substantially vertical surface of the framing of a corner of a structure being framed, the second pole support is located outside that corner at a location that approximately bisects that corner, wherein the corner bracket further comprises at least a first planar member connecting at least one of the first and second plates to the second pole support, wherein at least one of the first and second plates comprise at least one attachment hole adapted to retain at least one fastener to fasten the corner bracket to at least one substantially vertical surface of the corner framing.

11. The guardrail support system of claim 10, wherein the corner bracket further comprises a second substantially planar member connecting at least one of the outer surfaces of the first plate and second plate to the second pole support, wherein the first and second substantially planar members are substantially parallel.

12. A guardrail support system, comprising:

a. a support bracket adapted to attach to a substantially vertical stud of a building framing, the support bracket comprising an attachment member and a pole support attached to the attachment member, the pole support comprising a cavity configured to receive a pole therein, wherein the attachment member comprises:

i. a planar attachment face having a first surface and a second surface on opposite sides thereof, wherein at least a portion of the second surface is adapted to be positioned against the substantially vertical stud, wherein the attachment face defines at least one attachment hole to attach the support bracket to the vertical stud via at least one fastener inserted through the hole and into the vertical stud;

ii. a plurality of reinforcing members extending along a periphery of the attachment face attached and perpendicular to the attachment face and projecting from the first surface away from the vertical stud, including at least a top reinforcing member, a bottom reinforcing member opposite and parallel to the top reinforcing member, and a side reinforcing member adjacent, perpendicular, and attached to the top and bottom reinforcing members to form an open box configuration, wherein the side reinforcing member is opposite and substantially parallel to the first pole support; and iii. a positioning member affixed to the second surface of the attachment face to function as a stop to accurately position an attachment surface of the attachment face of the attachment member against the vertical stud; and b. a pole configured to be inserted into the pole support.

13. The guardrail support system of claim 12, wherein when the support bracket is attached to the substantially vertical stud, the pole support comprises tubing whose length is substantially parallel to said vertical stud.

* * * * *